US005769458A

United States Patent [19]

Carides et al.

[11] Patent Number: 5,769,458

[45] Date of Patent: Jun. 23, 1998

[54] CARDS HAVING VARIABLE BENDAY PATTERNS

[75] Inventors: James J. Carides, Lawrenceville; Dana Kipland Duke, Gainesville; Benny R. Rich, Oakwood; Kathryn L. Matson, Norcross, all of Ga.

[73] Assignee: Dittler Brothers Incorporated, Atlanta, Ga.

[21] Appl. No.: 567,364

[22] Filed: Dec. 4, 1995

[51] Int. Cl.[6] ..... B42D 15/00

[52] U.S. Cl. ..... 283/102; 283/93; 283/94; 283/95; 283/901; 283/903; 427/256

[58] Field of Search ..... 283/93, 94, 95, 283/56, 100, 113, 901, 903, 102; 347/101, 105, 107; 427/256–282

[56] References Cited

U.S. PATENT DOCUMENTS

| | | | |
|---|---|---|---|
| 2,952,080 | 9/1960 | Avakian et al. | 35/2 |
| 3,914,877 | 10/1975 | Hines | 35/2 |
| 4,299,637 | 11/1981 | Oberdeck et al. | 156/64 |
| 4,586,711 | 5/1986 | Winters et al. | 283/901 X |
| 4,858,123 | 8/1989 | Alexoff et al. | 283/901 X |
| 5,002,313 | 3/1991 | Salvatore | 283/56 X |
| 5,137,304 | 8/1992 | Silverschotz et al. | 283/56 X |
| 5,346,258 | 9/1994 | Behm et al. | 283/102 |
| 5,542,710 | 8/1996 | Silverschotz et al. | 283/94 |
| 5,601,887 | 2/1997 | Rich et al. | 283/94 X |

FOREIGN PATENT DOCUMENTS

| | | | |
|---|---|---|---|
| 92/10371 | 6/1992 | WIPO | 283/100 |

OTHER PUBLICATIONS

Photocopy of Face of Sample "Trees of Life" Ticket of Pollard Banknote Limited.

*Primary Examiner*—Frances Han

*Attorney, Agent, or Firm*—Dean W. Russell; Geoff L. Sutcliffe; Kilpatrick Stockton LLP

[57] ABSTRACT

Alternative benday patterns for cards and tickets and methods of producing such patterns are disclosed. The alternative patterns enhance the effectiveness of conventional devices by avoiding use of rotating print cylinders, with fixed repeats, in their creation. The attendant reduction in, or elimination of, benday repetition inhibits vertical ticket splitting and other manner of compromise. Desired images, including play indicia, promotional content, or both, can also be visibly encoded in the benday patterns, if desired.

31 Claims, 7 Drawing Sheets

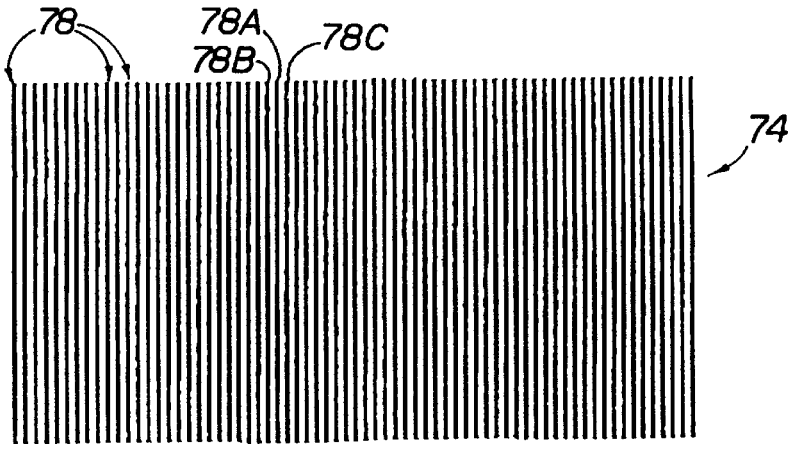
FIG 3A
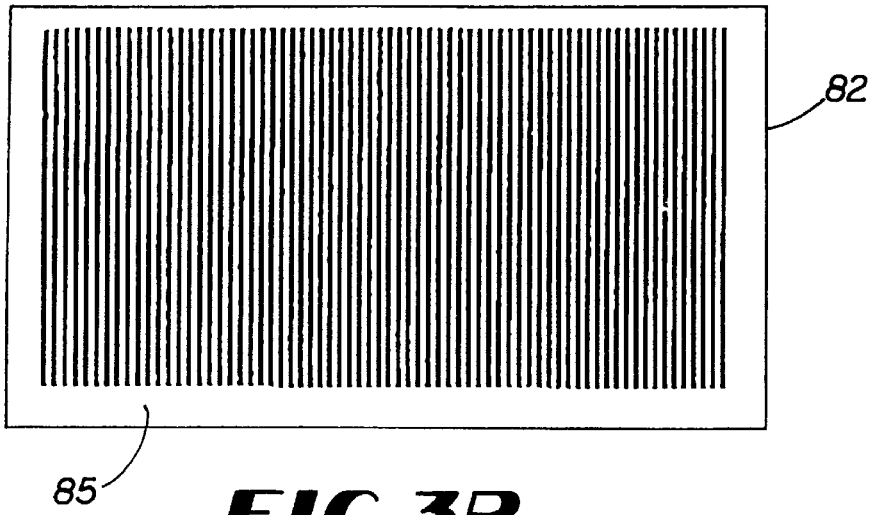
FIG 3B
DITTLER 86
BROTHER
FIG 3C

MESSAGE

SCRAMBLED IMAGE

DECODER

DECODED MESSAGE

CARDS HAVING VARIABLE BENDAY PATTERNS

FIELD OF THE INVENTION

This invention relates to game cards, and more particularly to lottery tickets, event tickets, and game and promotional pieces, having variable benday patterns.

BACKGROUND OF THE INVENTION

U.S. Pat. No. 5,346,258 to Behm, et al. discloses game cards of a type typically used as an instant-win lottery ticket. These cards include a paper or other substrate, play indicia, and a removable, opaque elastomeric coating covering the play indicia. In use a player removes, or scratches-off, the elastomeric coating to reveal the play indicia.

Also illustrated in the Behm patent are conventional benday patterns interposed between the substrate and play indicia. As discussed at column 3, lines 17–20 therein, "a blue along with a red benday pattern . . . are printed on the substrate primer." According to the Behm patent, the purpose "of the benday patterns . . . is to detect vertical ticket splitting." In other words, because the benday patterns of any two selected tickets are reasonably likely to differ, removing a portion of the play area of one card and transferring it to another will probably result in visible discontinuities in the benday patterns.

Shown in FIGS. 1 and 3 of the Behm patent are the wavy lines that characterize most conventional benday patterns for lottery tickets and other game cards. The earlier "Trees of Life" ticket of Pollard Banknote Ltd. is substantially identically configured, substituting only solid, radially-extending lines for the wavy lines of the Behm patent. To create either pattern, a "fingerprint," or set, of lines is generated and prints are made of various sections of the set. These prints are then used to create the intaglio plates of a cylindrical, rotogravure print mechanism that imprints the cards or tickets. Because the cylinder has a fixed diameter, however, its "repeat"—the number of tickets printed during one rotation—is finite.

Accordingly, although each print of a section of the set may differ from the other prints, it is used repeatedly throughout the printing process. If, as an example, twelve tickets are printed with each rotation of the cylinder, the benday patterns of the first and thirteenth tickets will be identical. This likeness, of course, decreases the effectiveness of conventionally-printed benday patterns, as removing a portion of the play area of the thirteenth ticket in this example and transferring it to the first ticket may not yield visible discontinuities. Other means of compromising conventional red-and blue-lined benday patterns that exploit the repetitiveness of the patterns also exist.

SUMMARY OF THE INVENTION

The present invention, by contrast, enhances the effectiveness of benday patterns by avoiding use of rotating print cylinders in their creation. Instead of printing sets of wavy lines with a fixed repeat, for example, the present invention utilizes a computerized variable printing device to supply continuously variable images, avoiding the inherently repetitive, conventional means of rotagravure, offset printing or other fixed-pattern printing approaches. For example, but without limitation, the continuously variable images can be applied by an ink-jet printer.

According to another aspect of the present invention, these images can also be "scrambled," or visibly encoded, if desired, to further deter compromise. The removal or obliteration of even a portion of such an image by an unscrupulous player will be detectable upon decoding of the corresponding card.

The present invention thus provides an alternative to existing benday patterns for inhibiting, among other actions, vertical ticket splitting. An ancillary benefit of the invention is its possible use as an alternative to existing confusion patterns, such as that shown in FIG. 2 of the Behm patent. Whereas the relevant removable patterns of the Behm patent appear intended solely to deter candling, the non-removable variable benday patterns of the present invention may perform both this and the previously-discussed functions. Thus, a single pattern of the present invention may substitute for two or more patterns or layers conventionally used.

Moreover, including an encoded pattern in the variable benday further reduces the likelihood of successful compromise by fraudulent transfer of portions of card play areas. The decoded variable benday image is not only a security feature, however, but may also comprise game information, promotional information, or both.

It is therefore an object of the present invention to enhance the effectiveness of existing benday patterns.

It is another object of the present invention to provide continuously variable benday patterns for use with, for example, lottery tickets, event tickets, promotional pieces, and other cards.

It is also an object of the present invention to avoid use of rotating cylinders with fixed repeats during the printing of benday patterns.

It is a further object of the present invention to provide visibly encoded images to deter, among other actions, vertical ticket splitting.

It is an additional object of the present invention to provide patterns also useful for inhibiting candling.

It is yet another object of the present invention to provide variable patterns for deterring the fraudulent transfer of indicia from one card to another.

It is still another object of the present invention to provide variable encoded benday patterns or images for deterring fraudulent transfer of game indicia from one card to another, as well as for containing game or promotional indicia, viewable upon decoding of the variable benday.

Other objects, features, and advantages of the present invention will become apparent with reference to the remainder of the written portion and the drawings of this application.

BRIEF DESCRIPTION OF THE DRAWINGS

FIG. 3A–F are a sequence of views illustrating creation of an encoded image in the card of FIG. 2 and of a decoding device that may be used in connection with the card.

DETAILED DESCRIPTION

Figure 1:
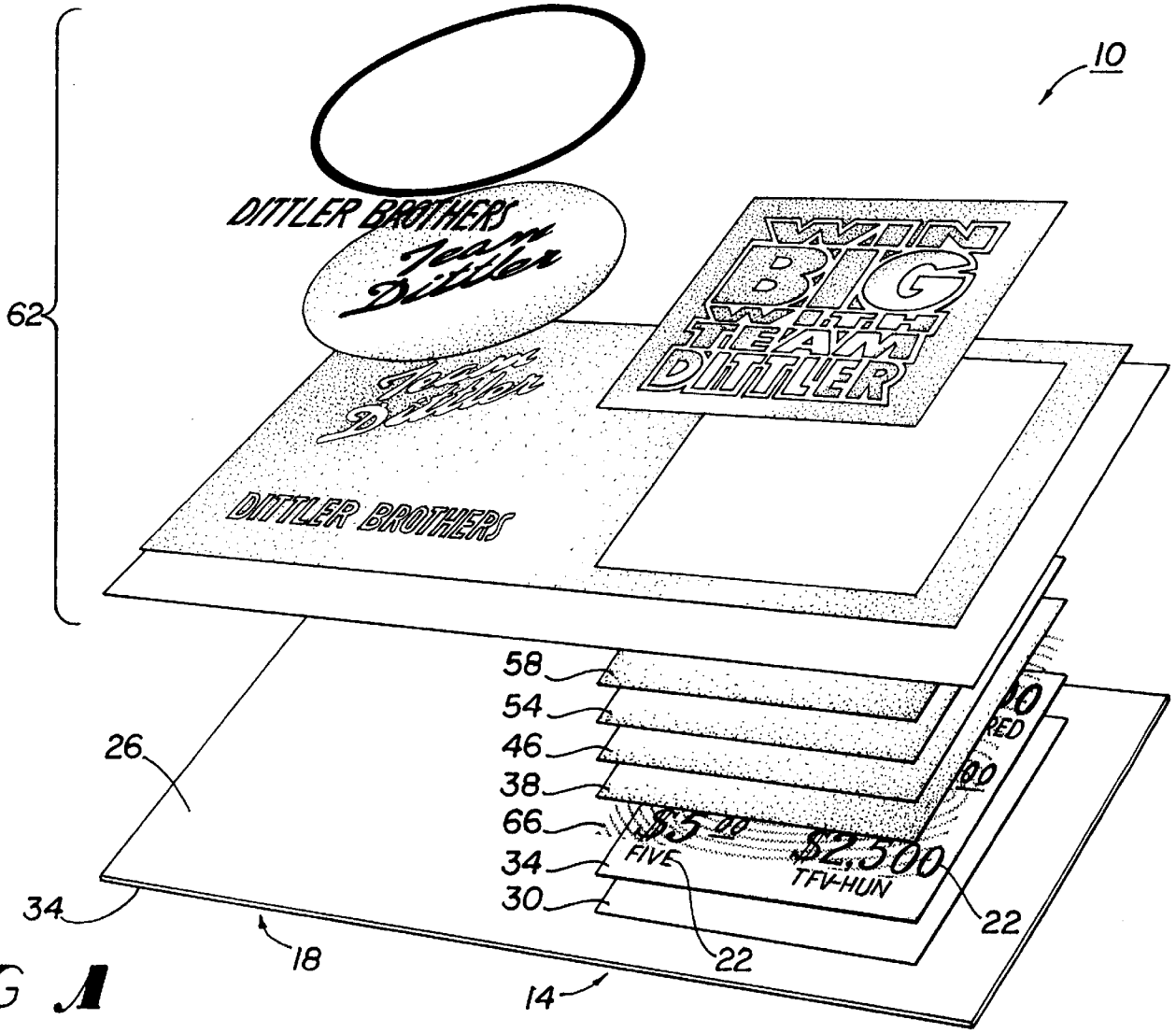
FIG. 1 is an exploded perspective view of a card of the present invention, including a variable benday pattern.

FIG. 1 illustrates an embodiment of card 10 of the present invention. If desired, card 10 may be divided into "secure" and "unsecure" areas 14 and 18, respectively, with symbols 22 printed in secure area 14. Such symbols 22, initially covered by opaque material (and therefore hidden from view), provide the information sought by the player or purchaser of card 10.

As shown in FIG. 1, card 10 comprises a paper base 26, which may (but need not) be conventional eight or ten point board stock. Alternatively, foil or a synthetic substrate may be used as the base of card 10. FIG. 1 also illustrates various ink layers and coatings that may be applied to base 26 to enhance the security of card 10. As detailed in FIG. 1, foundation coating 30 covers the portion of base 26 in secure area 14. Foundation coating 30 increases the opacity of card 10, reducing the possibility of successful optical compromise through candling. Card 10 may also include contrast coating 34 if desired, typically a white or light-colored material onto which darker symbols are printed. Both foundation coating 30 and contrast coating 34 (when present) are adapted to receive the ink used to print symbols 22 and, for card 10, provide a durable surface to substitute for that otherwise furnished by foil.

Foundation coating 30 comprises a dark-colored, solvent-soluble ink (e.g., blue) with a high metal content (typically aluminum, bronze, or copper) and a vinyl chloride base resin. Foundation coating 30 additionally may, but need not, include carbon black to inhibit electrostatic tampering from the underside 36 of card 10. Like foil, the colored ink and other contents of foundation coating 30 further prevent unscrupulous players from viewing symbols 22 by removing the fibers from base 26. The fugitive dye of foundation coating 30 (if present) also is designed to bleed through underside 36 of card 10 when immersed in chemicals, evidencing an attempt to wick the ink of symbols 22 to underside 36 for viewing by an unscrupulous player. A suitable contrast coating 34 for card 10 is a vinyl chloride resin (dissolved in acetate solvent) with titanium dioxide pigment.

Seal coating 38 covers symbols 22 and functions as a barrier to seal symbols 22 from other coatings applied to card 10 and guard against chemical tampering by unscrupulous players. Card 10 may additionally include a second sealant (not shown) for similar purposes and to reduce reliance on automatic equipment fully covering symbols 22 with seal coating 38. In these embodiments, either or both of seal coating 38 and the second sealant may be a water-white solution of vinyl chloride resin. Although transparent, either seal coating 38 or the second sealant may be tinted if desired to inhibit or deter photocopying of symbols 22.

At least one release coating 46, applied over seal coating 38, permits first and second latex coverings 54 and 58, when present, to be removed by the player to reveal symbols 22. Release coating 46 typically contains alcohol-soluble polyamide resin and zinc stearate, and may contain silicone as well. This structure permits card 10 to withstand greater temperatures without degradation than other typical non-foil pieces, reducing the possibility of successful heat-based tampering by unscrupulous players. Utilizing more than one release coating 46 allows each to be thinner than a single coat, furthermore, thereby drying more quickly and allowing more rapid processing through automatic equipment. Multiple release coatings 46 also promote complete coverage of secure area 14 and facilitate more rapid and easier removal of respective first and second (latex) coverings 54 and 58 by the player.

Alternatively, release coating 46 may be a varnish cured by ultraviolet radiation to enhance the gloss of card 10 and further seal the layers of the card 10 from contaminants or abrasion. Because this coating 46 is not air-dried, it remains unfixed until exposed to ultraviolet radiation. Non-uniformities in the thickness of applied coating 46, therefore, remain amenable longer to correction, providing a smoother, glossier result than many air-dried coatings. Exemplary compositions for such release coating 46 include (by weight) approximately 55–65% monomer, 15–25% epoxy oligomer, 8–10% benzophenone and, if appropriate, various anti-foamants, flow/leveling agents, photo-initiators, and synergists. Because these components cross-link when exposed to ultraviolet radiation, this alternative release coating 46 typically cures to a hard and durable finish. The alternative release coating 46 may additionally substitute for either or both of seal coating 38 or the second sealant (and may therefore also include a colorant).

Applied atop release coating 46 is first covering 54. First covering 54 is an opaque, typically (although not necessarily) silver latex comprising solvent-soluble synthetic rubber with predispersed pigment and is available from KVK USA, 19A Home News Road, New Brunswick, N.J. 08901. Second covering 58, applied atop first covering 54 of FIG. 1, is also an opaque, solvent-soluble synthetic rubber containing predominantly metal particles (such as aluminum, copper, or bronze) and black pigment. First and second coverings 54 and 58 combine to inhibit candling of card 10, with the metallic composition and black pigment present additionally deterring certain chemical tampering of the card 10. Because the synthetic rubber of first and second coverings 54 and 58 is an electrical insulator and does not react with acids or bases, card 10 is less likely to be electrically or chemically compromised by an unscrupulous player as well. In some embodiments of card 10, first covering 54 may also include metal particles to enhance opacity, or be otherwise appropriately formulated to provide a removable means for obscuring symbols 22 from view.

Overprinting 62 may also be applied to card 10. Examples of such overprinting 62 are disclosed in commonly-assigned U.S. patent application Ser. No. 08/407,185. Card 10 additionally may be embossed (not shown), as described in commonly-assigned U.S. patent application Ser. No. 08/452,873.

Further illustrated in FIG. 1 is benday pattern 66. Although generally composed of wavy lines similar to the corresponding pattern of the Behm patent, benday pattern 66 differs from that of the Behm patent. In particular, benday pattern 66 is not printed using a plate and cylindrical rotogravure print mechanism. Instead, benday pattern 66 is generated in the same manner (and, optionally, at the same time) as symbols 22, using, for example, a computerized ink-jet printer (such as the Mead 3600 printer, available from SCITEX Digital Printing, Inc., 3100 Research Blvd., Dayton, Ohio 45420-4099). Printers of this sort are capable of printing with a resolution of 240 dots per inch (dpi). Other suitable, computer-drivable, variable printing technologies, including those that are presently available, as well as those yet to be developed, could also be used to practice the present invention.

To create benday pattern 66, a representation of the spaced lines of a pattern may be generated digitally and stored in a suitable memory device. Such representation may be made using Adobe Photoshop, for example, well-known software presently commercially available. Upon command, the digital representation may be input to the Mead 3600 printer for printing as benday pattern 66. Such software may include instructions sufficient to cause randomized generation of continuous lines and curves for printing as the benday patterns 66 of cards following card 10. These cards may thus all include benday patterns 66 that differ from card to card, inhibiting vertical ticket splitting of any subset of cards and thereby avoiding the difficulties associated with use of printing mechanisms with fixed repeats.

Figure 2:
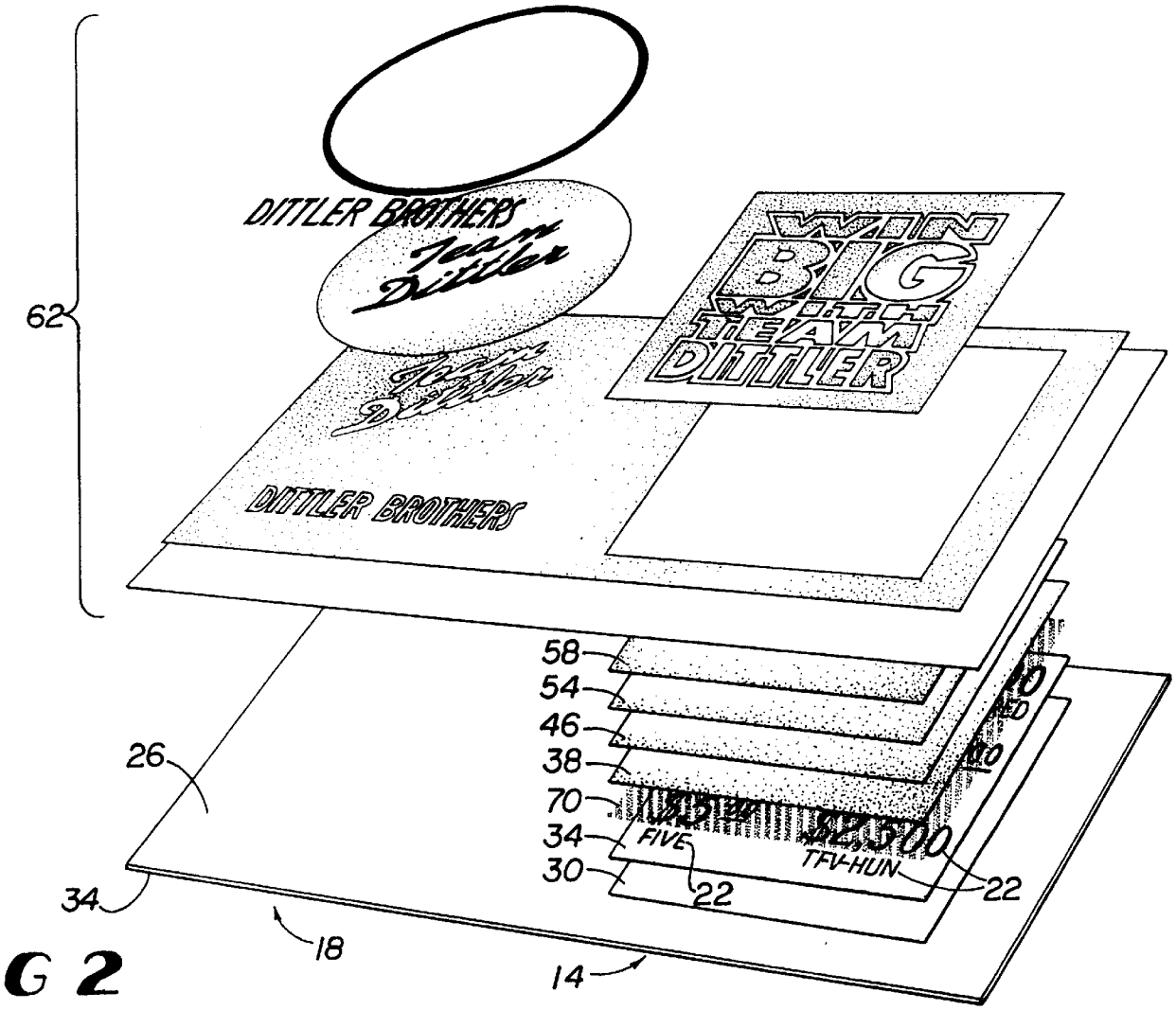
FIG. 2 is an exploded perspective view of an alternate embodiment of the card of FIG. 1, in which the variable benday pattern comprises an encoded image.

An alternative benday pattern 70 is shown in FIG. 2. Unlike the wavy lines of benday pattern 66, the image of pattern 70 has been "scrambled," or visibly encoded, to enhance compromise deterrence. Thus, pattern 70 not only inhibits vertical ticket splitting, but provides increased opacity to deter candling of card 10 as well.

Figure 3D:
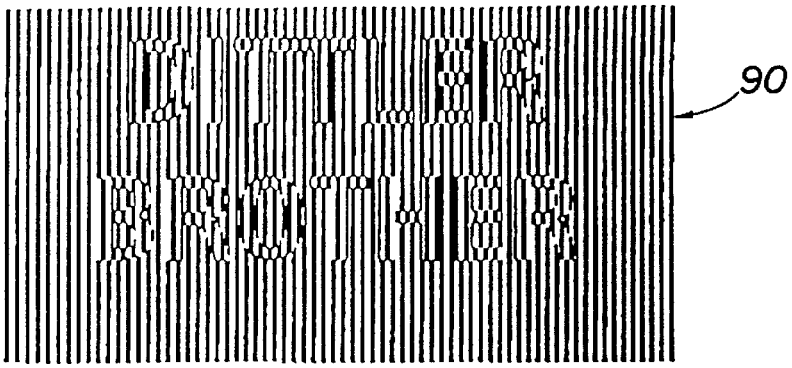

Creation of an exemplary pattern 70 is illustrated in FIGS. 3A–F. Shown in FIG. 3A is the base image 74 from which pattern 70 is formed. Base image 74 is composed of a series of parallel lines 78, each line 78A of the same length and width as the other lines 78 and evenly spaced from its adjacent lines 78B and 78C. Decoder 82 of FIG. 3B is identical to base image 74, although usually printed on clear plastic 86 for easy use.

To encode information such as graphic 86 (FIG. 3C), the outline of graphic 86 is used to reverse the striping of base image 74. In other words, if graphic 86 were simply placed over base image 74, the portions of lines 78 overlaid by solid areas of graphic 86 would be erased, or reversed, while the spaces of base image 74 overlaid by solid areas of graphic 86 would be filled in. The result 90—which effectively shifts the phase of portions of lines 78 of base image 74—is shown in FIG. 3D.

Figure 3E:
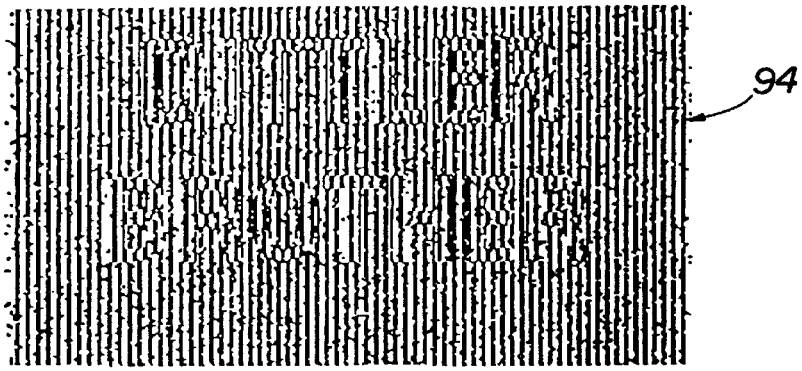
Figure 3F:
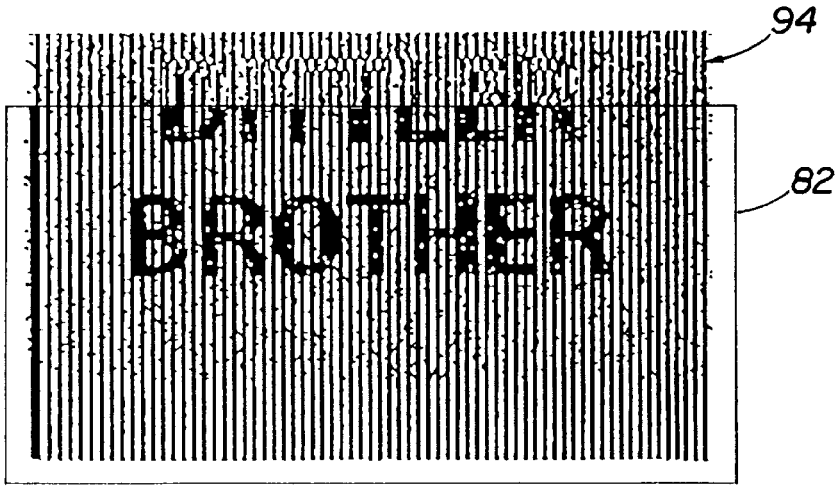

Because pattern 70, like benday pattern 66, may be created electronically for input to the computerized Mead 3600 printer, random or pseudo-random changes may be made to the electronic image of result 90. In essence, the state of various pixels, or dots, of result 90 may be changed (from solid to clear or vice-versa) randomly to obscure further the information contained in graphic 86. Such obscured image 94 is shown in FIG. 3E and constitutes an exemplary benday pattern 70. Benday pattern 70 may advantageously be applied using a continuously variable printing means, such as a suitable ink-jet printer, but also could be applied, if necessary but without the ability to vary the benday pattern, by conventional rotary printing means. After first and second coverings 54 and 58 of card 10 are removed to expose benday pattern 70 and symbols 22, pattern 70 may be decoded by placing decoder 82 over image 94 as shown in FIG. 3F, thereby revealing the information of graphic 86.

As should be apparent from the foregoing discussion, any attempt to remove part of benday pattern 70 and symbols 22 from card 10 and transfer it to a different card will disturb the information contained in graphic 86. Upon decoding with decoder 82, such disturbance will likely be immediately apparent. Moreover, graphic 86 of card 10 lacks recognizable features when in encoded form, making it difficult for an unscrupulous player to select such a graphic 86 to match that of a target card (not shown), or to ensure that a transferred portion of graphic 86 aligns with the graphic of the target card. For these reasons, attempts to compromise cards incorporating features of the present invention are highly likely to be detectable upon decoding. Use of benday pattern 70 should thus deter vertical ticket splitting, while any substantial opacity associated with image 94 may inhibit candling as well. Because benday pattern 70 may be generated electronically, furthermore, it can be changed easily and therefore differ for each card 10 manufactured.

Figure 4A:
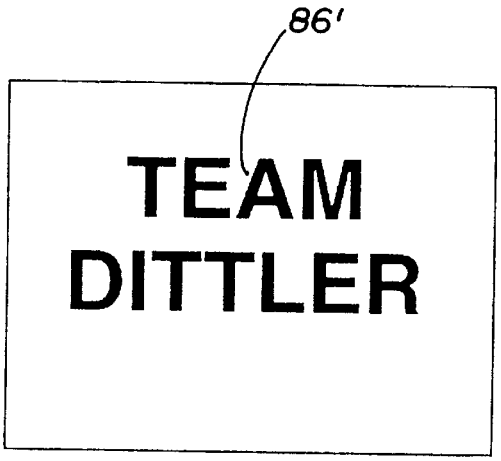
FIG. 4A–D are a sequence of views illustrating an alternative, higher resolution: encoded message or image in a benday pattern for a game card; the message or image in scrambled form; a decoder for the scrambled message or image; and the message or image as decoded.
Figure 4B:
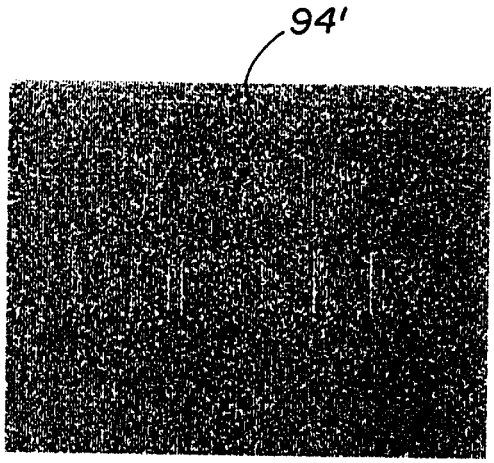
Figure 4C:
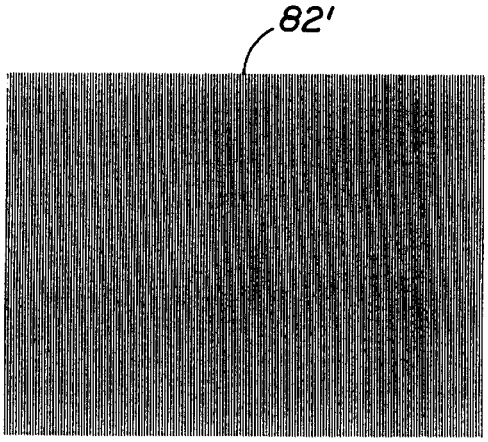
Figure 4D:
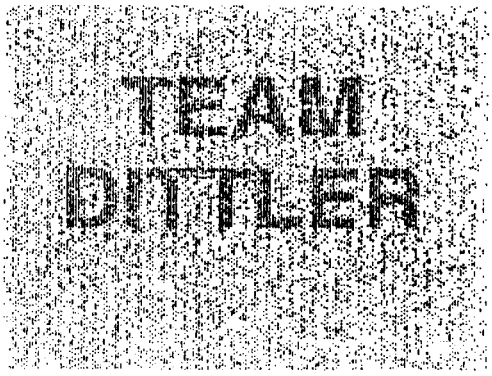

Although exemplary graphic 86 of FIG. 3C consists of a set of letters, the graphic 86 is not so limited, and may comprise numerals, pictures, or any other suitable or desired symbols. The fineness (or "grain size") of image 94 and decoder 82 may also be varied. An alternative, finer-grained embodiment than the one illustrated in FIG. 3A–F is provided in FIG. 4A–D. Graphic 86', shown in FIG. 4A, is scrambled or encoded (according to the technique described in connection with FIG. 3A–F) to yield image 94', in FIG. 4B. Having a finer grain size, image 94' should generally be more difficult for an unscrupulous player to manipulate. Furthermore, the comparative fineness of image 94' implies that defects in compromising a card by fraudulently transferring a portion of image 94' to another card may be more easily detected. The decoder 82', in FIG. 4C, necessary for revealing graphic 86' as a decoded message (shown in FIG. 4D), moreover, is comparatively more difficult to fabricate. This fact further complicates and inhibits tampering and compromise.

Benday pattern 70 incorporating image 94 need not be printed in black and white ink, but rather may be composed of any colored inks contrasting acceptably with symbols 22. Arrangements other than that of base image 74 of FIG. 3A, including those discussed in U.S. Pat. No. 2,952,080 to Avakian, et al., additionally may be employed. Alternatively, decoder 82 may constitute a UPC or other bar code associated with sales of card 10.

Figure 5A:
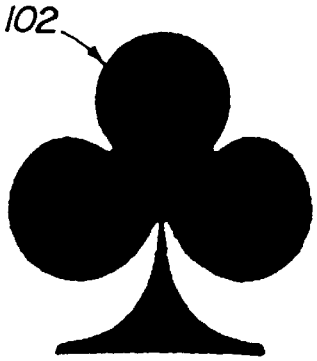
FIG. 5A–E are a sequence of views illustrating an alternative image for a card including the image in scrambled form, a decoder for the encoded image, a partially decoded view of the image, and a fully decoded view of the image.
Figure 5B:
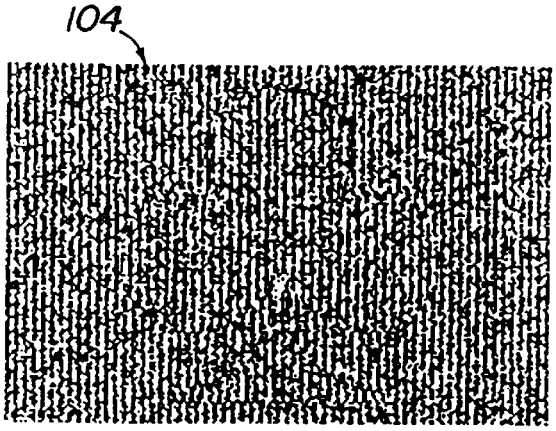
Figure 5C:
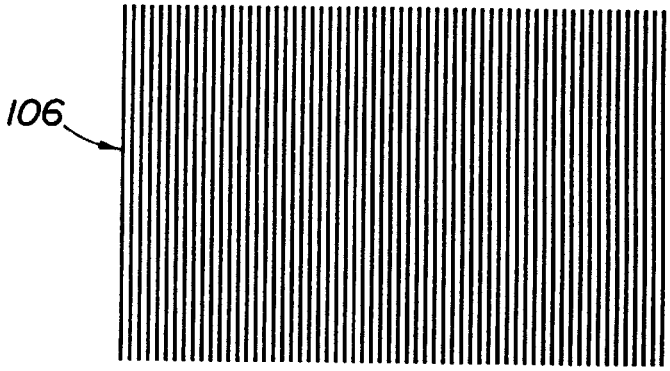
Figure 5D:
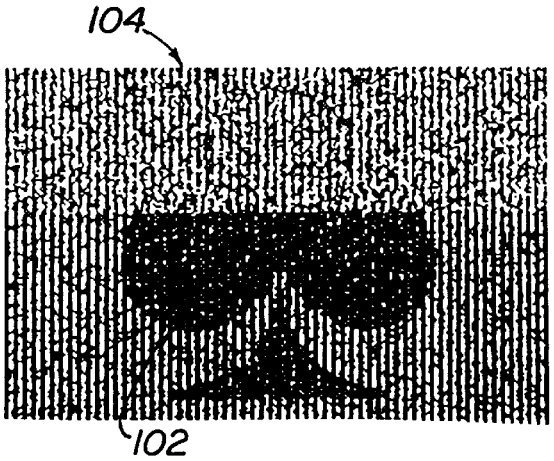
Figure 5E:
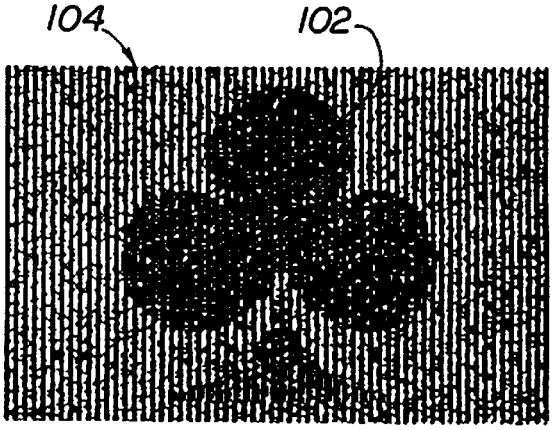

An embodiment of the present invention using an exemplary, encoded, non-alphanumeric symbol in the play area of a game card is shown in FIG. 5A–E and FIG. 6A–B. In this example, a club symbol is used for purposes of illustration. However, any play indicia, and/or logo, trademark, or other promotional information may be used. FIG. 5A shows an illustrative graphic 102 that will appear, when decoded, in the play area of a card. FIG. 5B shows a variable benday 104 containing graphic 102 in encoded form, arrived at by applying the methods described in connection with FIG. 3A–F. When the decoder 106, shown in 5C, is applied to encoded variable benday 104, graphic 102 is revealed. In FIG. 5D, variable benday 104 has been partially decoded by the overlay of decoder 106, so that a lower portion of graphic 102 is visible. The entirety of graphic 102 is visible in FIG. 5E, in which decoder 106 has been overlaid in its entirety on variable benday 104.

Figure 6A:
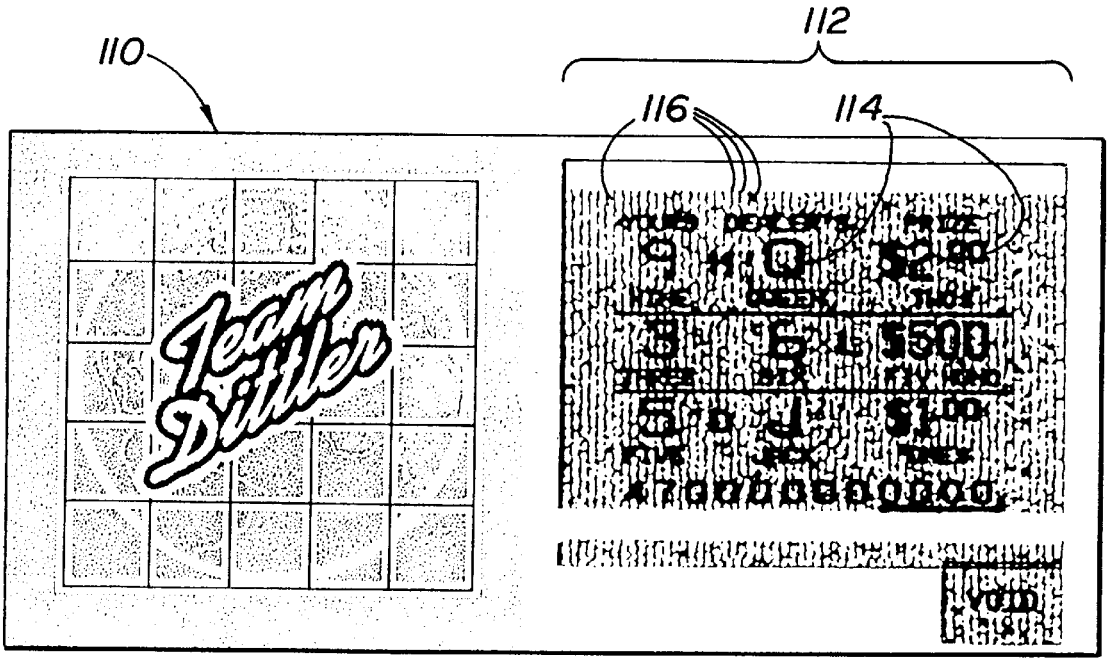
FIG. 6A–B are, respectively, encoded and decoded views of a card having in encoded form the image of FIG. 5A–E.
Figure 6B:
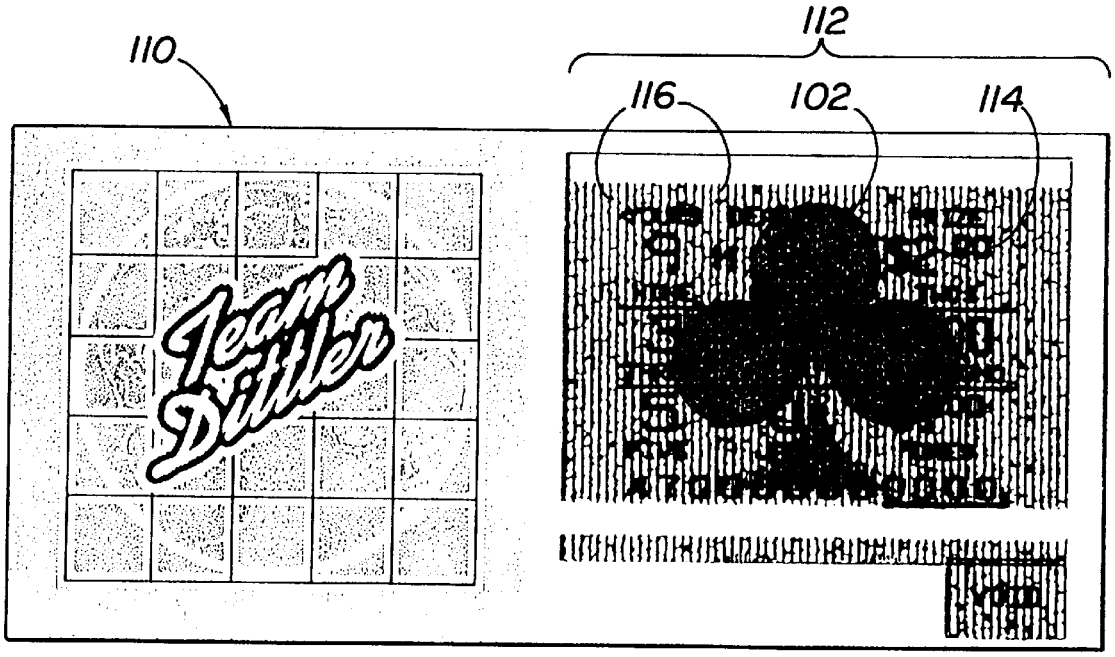

An embodiment of a game card 110 containing an encoded variable benday according to the present invention is illustrated in FIG. 6A. The right half of the card 110 includes a game play area 112 having various play indicia 114. The game indicia 114 appear on a field defined by encoded variable benday 116. As can be seen in FIG. 6*a*, no pattern or image in encoded variable benday 116 can be readily discerned. The presence of the game indicia 114 further obscures the presence of such a pattern or image. Referring to FIG. 6B, however, the image 102 (the club of FIG. 5A) is visible when encoded variable benday 116 has been decoded. Because of the wide variety of possible configurations for graphics 86 (e.g., club image 102), their use is not limited to enhancing security by deterring tampering and compromise, but also is ideal for promotional use and, in addition (or alternatively), as play indicia. The graphic 86 revealed by decoding benday 70 may comprise a trade name, logo, or other promotional symbol, and/or indicate that the player has (or has not) won a prize.

As yet another alternative, decoder 82 may be incorporated into card 10. Including on card 10 a chemical coating that reacts to exposure, or being rubbed with a coin or other object, and in a pattern that decodes the information contained in graphic 86 when rubbed, for example, avoids the need for a separate decoder 82. An embodiment of card 10 so designed could include a coating of titanium dioxide pigment over benday pattern 70. When the coating is abraded by a coin or other metallic surface, it is converted to a series of dark (e.g. gray or black) bars so as to decode pattern 70.

As an alternative to metallic reactive inks, the incorporation of thermochromic, photochromic, scratch reactive or alternative chemistries may be employed.

The foregoing is provided for purposes of illustrating, explaining, and describing embodiments of the present invention. Further modifications and adaptations to these embodiments will be apparent to those skilled in the art and may be made without departing from the scope or spirit of the invention.

We claim:

1. A game card comprising:

a. a substrate;

b. a set of digitized information printed on the substrate using a computerized, non-rotogravure printer, the set of digitized information including:

i. play indicia; and ii. a benday pattern; and c. a removable, opaque elastomeric coating covering the play indicia and benday pattern;

wherein the benday pattern printed on the substrate is encoded.

2. The game card according to claim 1, wherein the encoded benday pattern the benday pattern encoded by a series of lines.

3. The game card according to claim 1, wherein the encoded benday pattern includes a second set of play indicia.

4. The game card according to claim 1, wherein the encoded benday pattern includes promotional information.

5. The game card according to claim 1, wherein the encoded benday pattern includes a second set of play indicia and promotional information.

6. The game card according to claim 1, wherein the encoded benday pattern further comprises a plurality of essentially-randomly situated dots.

7. The game card according to claim 1, further comprising means, comprising a chemical coating applied over the encoded benday pattern, for decoding the encoded benday pattern upon removal of the opaque elastomeric coating.

8. The game card according to claim 1, wherein the play indicia printed on the substrate comprises encoded play indicia.

9. The game card according to claim 8, wherein the encoded play indicia comprises the play indicia encoded by a series of lines.

10. The game card according to claim 8, wherein the encoded play indicia further comprises a plurality of essentially-randomly generated dots.

11. A method of producing a game card, comprising the steps of:

a. providing a substrate;

b. printing using a computerized, non-rotogravure printer a set of digitized information onto the substrate, the set of digitized information including:

i. play indicia; and ii. a benday pattern; and c. covering the play indicia and benday pattern with a removable, opaque elastomeric coating.

12. The method of producing the game card according to claim 11, wherein the step of printing the set of digitized information comprises a step of selecting the benday pattern for the game card from a plurality of benday patterns so that the benday patterns are not regularly repeated on other game cards.

13. The method of producing the game card according to claim 11, further comprising a step of digitizing the set of the information in the form of the benday pattern before printing the set of information onto the substrate.

14. The method of producing the game card according to claim 11, wherein the step of printing onto the substrate comprises a step of printing the set of digitized information in the form of the benday pattern comprising a series of lines.

15. The method of producing the game card according to claim 14, wherein the step of printing onto the substrate comprises a step of printing the set of digitized information in the form of the benday pattern encoded by the series of lines.

16. The method of producing the game card according to claim 15, wherein the step of printing onto the substrate comprises steps of printing the set of digitized information in the form of the benday pattern and printing a plurality of essentially-randomly situated dots on the substrate.

17. The method of producing the game card according to claim 11, wherein the set of digitized information in the form of the benday pattern comprises play indicia.

18. The method of producing the game card according to claim 11, wherein the set of digitized information in the form of the benday pattern comprises promotional information.

19. The method of producing the game card according to claim 11, wherein the set of digitized information in the form of the benday pattern comprises play indicia and promotional information.

20. The method of producing the game card according to claim 11, wherein the step of printing onto the substrate comprises a step of printing the set of digitized information in the form of a benday pattern comprising a series of wavy lines.

21. The method of producing the game card according to claim 11, further comprising a step of applying over the benday pattern a chemical coating for decoding the set of digitized information upon removal of the opaque elastomeric coating.

22. The method of producing the game card according to claim 11, wherein the step of printing the set of digitized information onto the substrate includes the steps of providing a base image and encoding the benday pattern with the base image to produce an encoded benday pattern.

23. The method of producing the game card according to claim 22, wherein the step of providing the base image comprises a step of providing a series of evenly spaced parallel lines.

24. The method of producing the game card according to claim 22, wherein the step of encoding the benday pattern comprises the steps of superimposing the benday pattern onto the base image and reversing the base image in areas of overlap between the base image and the benday pattern.

25. The method of producing the game card according to claim 22, further comprising a step of obscuring the encoded benday pattern.

26. The method of producing the game card according to claim 25, wherein the step of obscuring the encoded benday pattern includes a step of changing portions of the encoded benday pattern to provide an appearance of randomly generated images.

27. The method of producing the game card according to claim 22, wherein the step of encoding the benday pattern with the base image to produce the encoded benday pattern includes a step of encoding at least part of the play indicia with the base image to produce encoded play indicia.

28. The method of producing the game card according to claim 22, wherein the step of encoding the benday pattern with the base image to produce the encoded benday pattern includes a step of encoding a second set of play indicia with the benday pattern.

29. The method of producing the game card according to claim 11, wherein the step of printing the set of digitized information onto the substrate includes the steps of providing a base image and encoding the play indicia with the base image to produce encoded play indicia.

30. The method of producing the game card according to claim 22, further comprising a step of applying a chemical coating over the encoded benday pattern wherein the chemical coating decodes the benday pattern upon removal of the opaque elastomeric coating.

31. The method of producing the game card according to claim 29, further comprising a step of applying a chemical coating over the encoded play indicia wherein the chemical coating decodes the play indicia upon removal of the opaque elastomeric coating.

* * * * *